US005435466A

United States Patent [19]

Du

[11] Patent Number: 5,435,466

[45] Date of Patent: * Jul. 25, 1995

[54] CONDIMENT DISPENSING DEVICE

[76] Inventor: Benjamin R. Du, 22832 Skyview Way, Laguna Beach, Calif. 92677

[ * ] Notice: The portion of the term of this patent subsequent to Jul. 27, 2010 has been disclaimed.

[21] Appl. No.: 228,756

[22] Filed: Apr. 18, 1994

Related U.S. Application Data

[63] Continuation of Ser. No. 65,537, May 20, 1993, Pat. No. 5,350,083, which is a continuation-in-part of Ser. No. 12,940, Feb. 3, 1993, Pat. No. 5,361,943.

[51] Int. Cl.[6] ..... B67D 1/16

[52] U.S. Cl. ..... 222/108; 222/134; 222/136; 222/144.5; 222/334; 222/341; 417/395

[58] Field of Search ..... 222/134–136, 222/108, 144.5, 309, 341, 334, 340, 287; 137/312, 625.61; 417/394, 395, 401, 566; 251/321, 200; 92/240

[56] References Cited

U.S. PATENT DOCUMENTS

| | | | |
|---|---|---|---|
| 2,842,160 | 7/1958 | Rekettye | 222/108 |
| 3,830,405 | 8/1974 | Jaeger | 222/334 |
| 4,124,147 | 11/1978 | Priese et al. | 222/135 |
| 4,619,378 | 10/1986 | de Man | 222/144.5 |
| 4,753,370 | 6/1988 | Rudick | 222/105 |
| 4,793,524 | 12/1988 | Starr | 222/309 |
| 4,815,634 | 3/1989 | Nowicki | 222/309 |
| 4,930,555 | 6/1990 | Rudick | 141/98 |
| 5,158,210 | 10/1992 | Du | 222/334 |
| 5,170,912 | 12/1992 | Du | 222/334 |
| 5,230,443 | 7/1993 | Du | 222/334 |
| 5,350,083 | 9/1994 | Du | 222/134 |
| 5,361,943 | 11/1994 | Du | 222/134 |

*Primary Examiner*—Andres Kashnikow
*Assistant Examiner*—Philippe Derakshani
*Attorney, Agent, or Firm*—Stetina Brunda & Buyan

[57] ABSTRACT

An improved condiment dispensing system for delivering a measured quantity of condiment at a desired flow rate. The system comprises a pump which is fluidly connected to a condiment source and a dispensing apparatus. The dispensing apparatus includes a valve assembly which is connected to a pressurized fluid source and to the pump whereby actuation of the valve assembly causes a measured quantity of the condiment to be dispensed from an outlet nozzle contained thereon.

2 Claims, 4 Drawing Sheets

FIG. 8
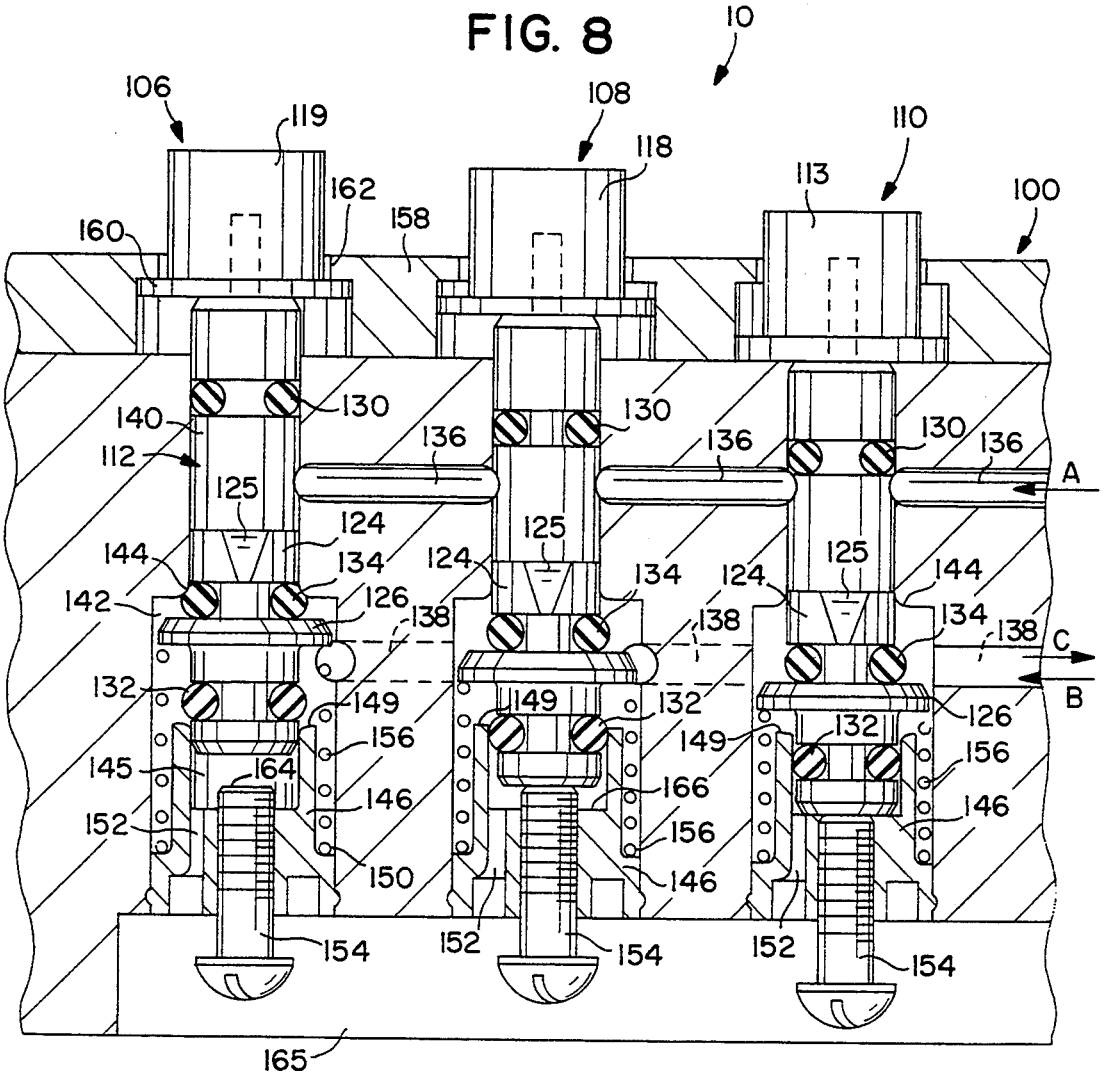
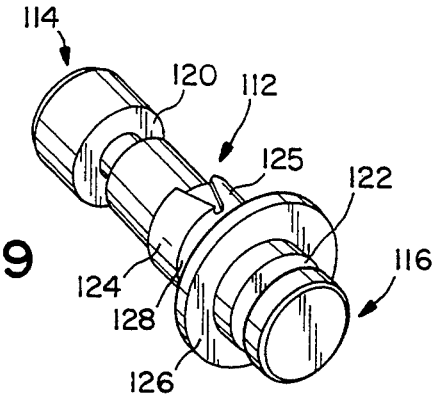
FIG. 9

CONDIMENT DISPENSING DEVICE

This application is a continuation of application Ser. No. 08/065,537, filed May 20, 1993, now U.S. Pat. No. 5,350,083 which is a Continuation In Part of Ser. No. 08/012,940, filed Feb. 3, 1993, now U.S. Pat. No. 5,351,943.

FIELD OF THE INVENTION

The present invention relates to an improved fluid-driven pump apparatus and method for pumping a viscous product, such as condiments used in the food service industry. More particularly, the present invention relates to a pumping apparatus which is adapted to eliminate the drippage of residual condiment immediately subsequent to the dispensation of a condiment product therefrom.

BACKGROUND OF THE INVENTION

As is well known, a variety or products typically marketed by fast-food retail establishments are provided to consumers after having been prepared with condiments such as ketchup, mustard, mayonnaise, relish and Thousand Island dressing. In this regard, many such establishments currently utilize manual dispensing systems for such condiments which deliver a metered quantity of the condiment therefrom.

The majority of prior art condiment-dispensing systems generally comprise portable, hand-held, manually-activated dispensing devices which are used to supply a quantity of the condiment to a food product. Although such prior art dispensing systems have generally proven suitable for their intended purposes, they possess inherent deficiencies which have detracted from their overall effectiveness and use in the trade.

The foremost of these deficiencies has been the inability of the prior art dispensing devices to dispense more than one variety of condiment, in that such devices are typically suited for dispensing only one condiment at a time. Moreover, the dispensing devices currently known are generally hand-held, mechanical devices, having a storage hopper for the condiment. Due to the relatively small size of the hopper needed to permit proper handling and manipulation of the device by the user, such devices must be refilled frequently with the condiment. This need for frequent refilling decreases the operational effectiveness of the device and gives rise to a greater likelihood of condiment contamination since the device is more susceptible to having a foreign material introduced thereinto during a refilling operation.

Thus, there has existed a substantial need in the art for a reliable, relatively inexpensive apparatus for dispensing a variety of condiments through a Single dispensing unit in a metered quantity and at a low flow rate, which is adapted to be connected directly to corresponding modern, sanitary bag-in-box containers for such condiments, thereby eliminating the need for frequent refillings of the dispensing system and reducing the possibility of condiment contamination. In recognition of this need, the device disclosed in Application Ser. No. 08/012,940 of which the present application is a continuation-in-part was developed by the Applicant.

The condiment dispensing system disclosed in Ser. No. 08/012,940 comprises a fluid driven pump having a piston which is operable to draw a quantity of condiment from a condiment reservoir into an interior cavity of the pump via an inlet check valve when it moves through an intake stroke, and dispense the quantity of condiment from the interior cavity to a dispensing apparatus via an outlet check valve when it moves through an exhaust stroke. Threadably engaged to the piston is a wiper member having a peripheral edge disposed in abutting, sealed contact with the inner surface of the interior cavity. The wiper member moves concurrently with the piston and is operable to wipe the inner surface of the interior cavity during the intake and exhaust strokes of the piston so as to prevent any condiment from passing between the inner surface of the interior cavity and the piston to a location intermediate the piston and an end of the pump housing. The inclusion of the wiper member prevents the binding of the pump piston and the clogging of the inlet and outlet check valves by preventing the chunks or particles of highly viscous condiments such as relish from being captured between the piston and the inner surface of the interior cavity of the pump housing. The dispensing apparatus of the system includes a plurality of valve stems which are oriented relative a plurality of fluid passages in a manner operable to provide pressurized fluid to the pump to initiate an exhaust stroke of the piston when in a first position, and allow the pressurized fluid to be vented from the pump to initiate an intake stroke of the piston when in the second position. The valve stems are adapted to regulate the flow of pressurized fluid to the pump depending on the type of condiment being dispensed therefrom. In this respect, the flow rate of pressurized fluid to the pump may be selectively adjusted so that less viscous condiments such as mustard and ketchup will be prevented from being dispensed too rapidly from the pump in a manner causing such condiments to be splattered and sprayed from the dispensing apparatus rather than being evenly and smoothly dispensed.

Though this condiment dispensing system addresses many of the deficiencies of the prior art condiment dispensing systems, this system itself has certain deficiencies which detracts from its overall utility. In this respect, it has been found that immediately subsequent to the dispensation of a quantity of condiment from the dispensing apparatus as occurs during ah exhaust stroke of the piston, residual condiment from the dispensing apparatus frequently drips therefrom onto counters and/or floors, thus necessitating frequent clean-up of the food preparation area. The drippage problem is particularly evident when the dispensing apparatus is used to pump less viscous condiments such as ketchup and mustard, as opposed to condiments of increased viscosity such as relish or Thousand Island dressing. As such, there exists a need in the art for a condiment dispensing system having the characteristics of the system disclosed in Ser. No. 08/012,940, but which is further adapted to pull a vacuum within the product outlet of the pump during the intake stroke of the piston to eliminate drippage of the residual condiment from the condiment dispensing apparatus. The present invention addresses these and other deficiencies associated with the prior art condiment dispensing systems.

SUMMARY OF THE INVENTION

In accordance with a preferred embodiment of the present invention, there is provided a fluid-driven pump for use in a condiment dispensing system. The pump comprises a housing means having first and second ends and an inner surface which defines at least one interior cavity. Slidably positioned within the housing means is a piston which is reciprocably movable through intake and exhaust strokes within the interior cavity for selectively drawing a predetermined quantity of condiment thereinto and dispensing the predetermined quantity therefrom. Threadably engaged to and enclosing the second end of the housing means is a seal assembly which defines an inlet/exhaust port for supplying a pressurized fluid to a portion of the interior cavity intermediate the piston and second end of the housing for initiating an exhaust stroke of the piston. The inlet/exhaust port also facilitates the venting of the pressurized fluid from the interior cavity during the intake stroke of the piston. The housing means further includes a product inlet disposed in the first end thereof for placing the interior cavity in fluid communication with a condiment reservoir during the intake stroke of the piston, and a product outlet disposed in the first end for placing the interior cavity in fluid communication with a condiment-dispensing apparatus during the exhaust stroke of the piston. Additionally, disposed within the interior cavity is a first spring means which is directly engaged to the piston in a manner operable to bias the piston toward the second end of the housing means when the pressurized fluid is vented from the interior cavity via the inlet/exhaust port. Threadably attached to the piston is a wiper member having peripheral edge portions disposed in abutting, sealed contact with the inner surface of the housing. In the preferred embodiment, the .wiper member moves concurrently with the piston and is operable to wipe the inner surface of the housing means during the intake and exhaust strokes of the piston so as to prevent any condiment from passing between the inner surface of the housing means and the piston to a location intermediate the piston and the second end of the housing means.

The seal assembly threadably engaged to and enclosing the second end of the housing means preferably comprises a cap member which is threadably connected to the housing means for adjusting the pre-determined quantity of condiment drawn into and dispensed from the pump. In this respect, the seal assembly is cooperatively engaged to the piston in a manner wherein clockwise rotation of the cap member decreases the piston stroke, thereby decreasing the pre-determined quantity of the condiment, and counter-clockwise rotation of the cap member increases the piston stroke thereby increasing the quantity of the condiment.

The pump constructed in accordance with the present invention further comprises an inlet check valve positioned between the product inlet and the piston, and an outlet check valve positioned between the product outlet and the piston. The outlet check valve is adapted to pull a vacuum within the product outlet during the intake stroke of the piston to eliminate drippage of residual condiment from the condiment dispensing apparatus. The inlet and outlet check valves each comprise a tubular sleeve having an annular flange extending about the inner surface thereof which defines a beveled inner surface and an annular outer shoulder. Slidably positioned within the housing is a base member which is disposed intermediate the back end of the sleeve and the piston. Each check valve further includes a compression spring having a first end abutted against the outer shoulder of the flange portion and a second end which is abutted against the base member. Extending axially through the spring is an umbrella member having an arcuate proximal portion positioned on the beveled inner surface of the flange portion and a distal portion pivotally connected to the base member. The umbrella member is sized to compress the spring an amount sufficient to bias the proximal portion of the umbrella member into sealed engagement against the beveled inner surface of the flange portion. The inlet check valve is oriented such that the flow of condiment into the interior cavity during an intake stroke of the piston will force the proximal portion of the umbrella member away from the beveled surface of the flange portion and compress the spring. Similarly, the outlet check valve is oriented such that the flow of condiment out of the interior cavity during an exhaust stroke of the piston also forces the proximal portion of the umbrella member away from the beveled surface of the flange portion and compresses the spring.

In the preferred embodiment, the tubular sleeve of the outlet check valve is sized and slidably positioned in the housing in a manner wherein the sleeve is reciprocally movable within a space defined between the product outlet and the interior cavity. During the exhaust stroke of the piston, the sleeve of the outlet check valve slides within the space to a first position in abutting contact with a first annular shoulder defined by the product outlet. During the intake stroke of the piston, the sleeve slides within the space to a second position in abutting contact with a second annular shoulder defined within the housing. Advantageously, the movement of the sleeve from the first position to the second position is operable to pull a vacuum within the product outlet, thus preventing the drippage of the residual condiment from the dispensing apparatus. Importantly, each of the base members includes a plurality of apertures disposed therein for facilitating the passage of condiment therethrough.

Disposed external of the pump housing is a dispensing apparatus having a valve assembly disposed therein comprising a plurality of valve stems and associated fluid passages which are configured to alternatively supply a pressurized fluid to and vent the pressurized fluid from the interior cavity to initiate intake and exhaust strokes of the piston. The flow of the pressurized fluid to and from the interior cavity is regulated by the valve stems of the valve assembly which are reciprocally movable between first and second positions. The valve assembly further includes means for controlling the flow rate of the pressurized fluid which in turn regulates the flow rate of the predetermined quantity of condiment dispensed from the dispensing apparatus, When in the first position, each valve stem is operable to channel the pressurized fluid into the interior cavity of the pump thereby actuating the piston through an exhaust stroke and pushing the condiment from the interior cavity through the product outlet. When in the second position, each valve stem is operable to allow the pressurized fluid contained within the interior cavity to be vented to atmosphere. As the interior cavity is being vented, the intake stroke of the piston is facilitated by the action of the first spring means. During this intake stroke, the predetermined quantity of condiment is drawn into the interior cavity via the product inlet and inlet check valve. The product outlet through which the condiment is pushed during an exhaust stroke of the piston is connected to the dispensing apparatus thus allowing the condiment to be dispensed onto a food product through a dispensing aperture disposed within the dispensing apparatus.

In the preferred embodiment, a plurality of V-shaped notches disposed within an annular flange portion formed about each valve stem define flow passages which allow the pressurized fluid to be channeled through the valve assembly to the pump. In this respect, the flow control means of the valve assembly preferably comprises screws which are threadably received into the dispensing apparatus and serve as stops for the valve stems which are abutted thereagainst when in the second position. The screws are operable to increase the flow rate of the pressurized fluid through the V-shaped notches when rotated in a counter-clockwise direction, and decrease the flow rate of the pressurized fluid through the V-shaped notches when rotated in a clockwise direction. The dispensing apparatus preferably includes three identically configured valve stems sharing a common pressurized fluid inlet passage. Additionally, multiple, i.e. three, condiment pumps are included in the dispensing system wherein each is connected to a different condiment source. Thus, the dispensing apparatus is configured to independently dispense multiple, i.e. three, different types of condiments therefrom.

The present invention is economical, relatively mechanically simple, and is highly reliable in long-term, continuous, operation.

BRIEF DESCRIPTION OF THE DRAWINGS

These as well as other features of the present invention will become more apparent upon reference to the drawings wherein:

FIG. 8 is a cross-sectional view of the dispensing apparatus taken along line 5—5 of FIG. 1, illustrating the valve assembly including the valve stems and flow passages;

FIG. 9 is a perspective view of one of the three identically configured valve stems of the valve assembly;

DETAILED DESCRIPTION OF THE PREFERRED EMBODIMENT

Figure 1:
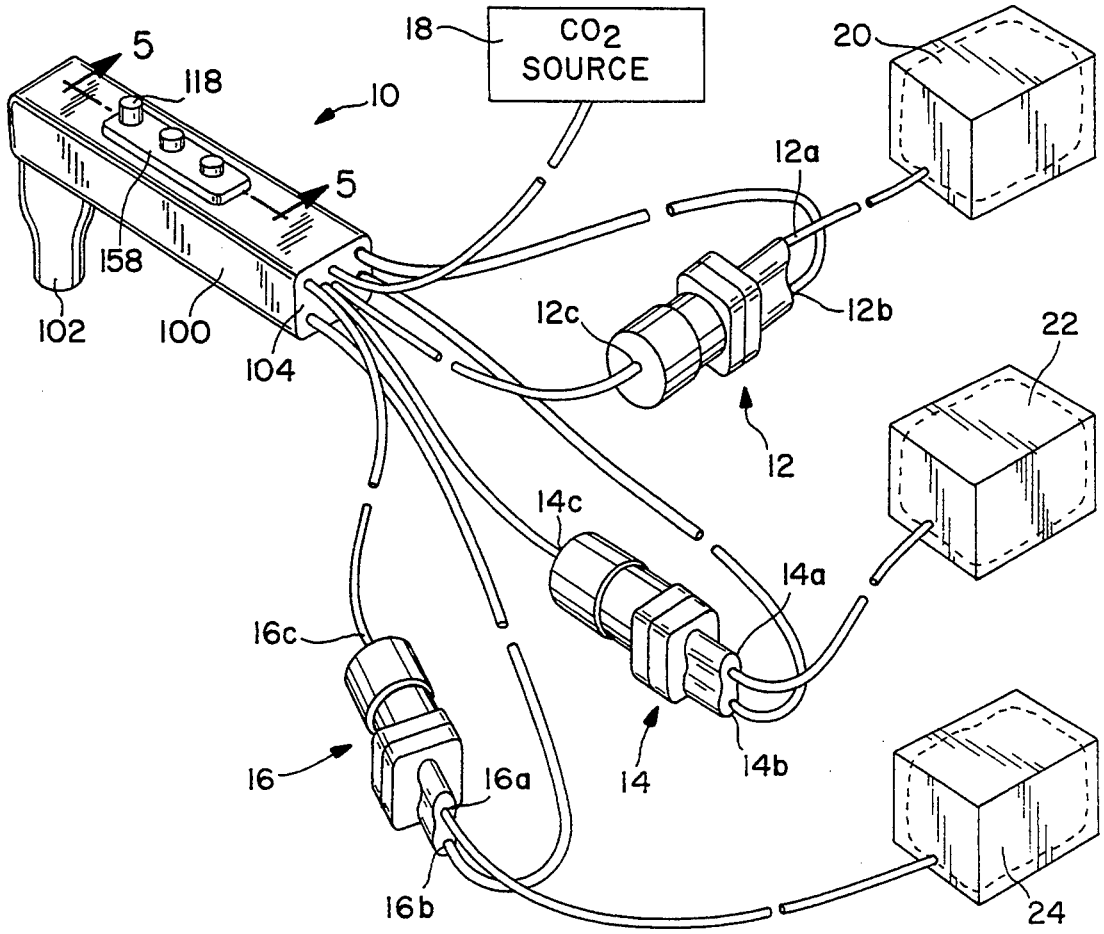
FIG. 1 is a perspective representation of a condiment dispensing system constructed in accordance with the present invention.
Figure 2:
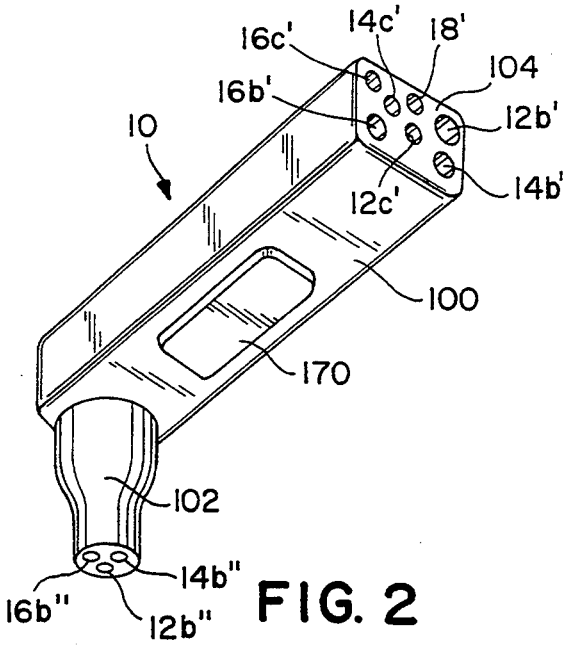
FIG. 2 is a rear perspective view of the dispensing apparatus used in conjunction with the dispensing system.
Figure 3:
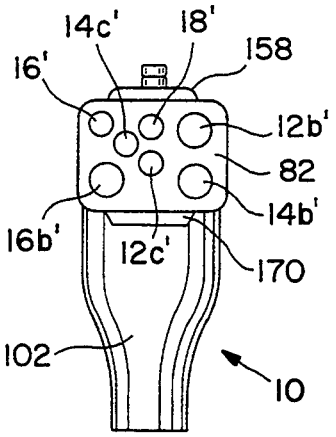
FIG. 3 is an end view illustrating the inlet and outlet ports of the dispensing apparatus shown in FIG. 2.

Referring now to the drawings wherein the showings are for purposes of illustrating a preferred embodiment of the present invention only, and not for purposes of limiting the same, FIG. 1 perspectively illustrates the condiment dispensing system constructed in accordance with the present invention. In the preferred embodiment, the dispensing system generally comprises a dispensing apparatus 10 fluidly connected to plural pumps, for instance a first pump 12, a second pump 14, and a third pump 16. Also connected to the dispensing apparatus 10 is a pressurized fluid source, which is preferably a carbon dioxide gas source 18. The pump 12 is also connected to a first condiment containing bag-in-box storage reservoir 20 while the second pump 14 is connected to a second bag-in-box reservoir 22, and the third pump 16 is connected to a third bag-in-box reservoir 24. In the operation of the dispensing system, the actuation of the dispensing apparatus 10 causes a quantity of condiment to flow from a respective bag-in-box 20, 22, 24 through a pumps 12, 14, 16 and into the dispensing apparatus 10, as will be described in greater detail below. As seen in FIGS. 1–3 and as more fully described below, the dispensing apparatus 10 is configured so as to be hand-held. However, it will be recognized that the dispensing apparatus 10 need not necessarily have a hand-held configuration, and may be constructed as a structure which remains in a fixed location on a countertop or other surface.

PUMP CONFIGURATION

Figure 4:
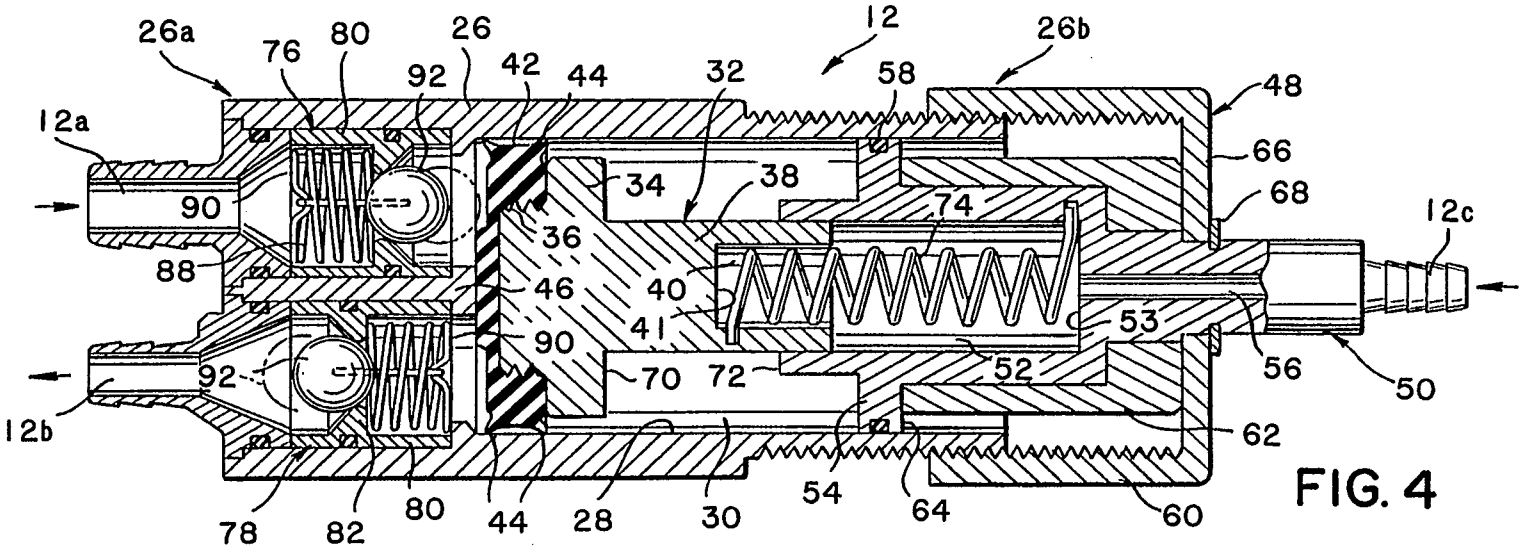
FIG. 4 is a cross-sectional view of a pump used in the condiment-dispensing system.

Referring now to FIG. 4, there is depicted a cross-sectional view of the pump 12. It should be noted that the pumps 12, 14, 16 have identical configurations, and that the pump 12 was arbitrarily selected to be described with regard to FIG. 4.

In the preferred embodiment, the pump 12 used in the condiment dispensing system comprises a pump housing 26 having a first end 26*a*, a second end 26*b*, and an inner surface 28 which defines an interior cavity 30. Slidably positioned within the interior cavity 30 of the housing 26 is a piston 32. The piston 32 is reciprocally movable through intake and exhaust strokes within the interior cavity 30 for selectively drawing a pre-determined quantity of a condiment thereinto and dispensing the pre-determined quantity therefrom, and is shown at the outer limit (i.e. full exhaust stroke) of its range of motion in FIG. 4. Disposed within and enclosing the first end 26*a* of the housing 26 is a product inlet 12*a* for placing the interior cavity 34 in fluid communication with a selected one of the reservoirs 20, 22, 24 during the intake stroke of the piston 32, and a product outlet 12*b* for placing the interior cavity 30 in fluid communication with the dispensing apparatus 10 during the exhaust stroke of the piston 32. When the piston 32 moves toward its inner limit during an intake stroke, condiment is introduced into the interior cavity 30 via the product inlet 12*a*. Conversely, when the piston 32 moves toward its outer position during an exhaust stroke, the condiment is pushed by the piston 32 out of the interior cavity 30 via the product outlet 12*b*.

In the preferred embodiment, the piston 32 defines an upper portion 34 having a recessed, threaded outer surface portion 36, and a generally cylindrical lower portion 38 which extends axially from the upper portion 34 and defines a cylindrically configured fluid-receiving cavity 40 in the bottom end thereof. Threadably engaged to the threaded, recessed portion 36 of the piston 32 is a wiper member 42 having a pair of peripheral edge portions 44 disposed in abutting, sealed contact with the inner surface 28 of the housing 26. When attached to the upper portion 34 of the piston 32, the wiper member 42 is configured so as to form a barrier between the piston 32 and the first end 26*a* of the housing 26. The wiper member 42 moves concurrently with the piston 32 during the intake and exhaust strokes thereof, and is operable to wipe the inner surface 28 of the housing 26 during the intake and exhaust strokes. Advantageously, this wiping action prevents any condiment from passing between the inner surface 28 of the housing 26 and the upper portion 34 of the piston 32 to a location intermediate the upper portion 34 and the inner surface 28 or the second end 26*b* of the housing 26. Since highly viscous condiments such as relish and Thousand Island dressing are comprised of or include large chunks or particles, the passage of such chunks to a location behind the upper portion 34 or between the upper portion 34 and the inner surface 28 could cause the binding of the piston 32 during its intake and exhaust strokes. As such, the wiper member 42 eliminates the susceptibility of the piston 32 to such binding by preventing the direct exposure of the piston 32 to any of the condiments, as previously described. As seen in FIG. 4, the exhaust stroke of the piston 32 is limited by the abutment of the central portion of the wiper member 42 against an internal partition 46 the housing 26.

In the preferred embodiment, the second end 26*b* of the housing 26 is enclosed by a seal assembly 48 which is threadably engaged to a threaded portion of the outer surface of the housing 26. The seal assembly 48 generally comprises a sealing member 50 which defines a cylindrically configured chamber 52 formed in coaxial alignment with and sized to slidably accommodate the cylindrical lower portion 38 of the piston 32. The sealing member 50 further defines a generally circular outer flange portion 54 and an elongate flow channel 56 having one end terminating into the chamber 52, with the other end terminating into a carbon dioxide inlet/exhaust port 12*c*. As seen in FIG. 4, the sealing member 50 is received into the second end 26*b* of the housing 26 in a manner wherein the outer edge of the flange portion 54 is in direct contact with the inner surface 28 of the housing 26. In this respect, the flange portion 54 includes an O-ring 58 disposed within a slot contained in the outer periphery thereof to form a seal between the sealing member 50 and the inner surface 28.

The seal assembly 48 further comprises an internally threaded cap member 60 which is, threadably engaged to the threaded outer surface of the second end 26*b* of the housing 26. Also included in the seal assembly 48 is an adapter member 62 which is configured to be positionable about the sealing member 50 in a manner wherein the lower rim thereof is abutted against the outer surface 64 of the flange portion 54. The cap member 60 is interfaced to the sealing member 50 via the compression of the non-threaded, laterally disposed end portion 66 thereof between the adapter member 62 and a snap ring 68 received into an annular slot disposed within the tubular portion of the sealing member 50 through which the flow channel 56 extends. Importantly, when the cap member 60 is threadably engaged to the housing 26, the cavity 40 disposed within the lower portion 38 of the piston 32 is coaxially aligned with the chamber 52 and flow channel 56 of the sealing member 50. Additionally, the bottom end of the lower portion 38 is received into the chamber 52 with the outer surface of the lower portion 38 and the inner surface of the chamber 52 being in sliding contact with each other.

As seen in FIG. 4, the depth of the chamber 52 exceeds the length of the lower portion 38 of the piston 32. In this respect, due to the slidable receipt of the lower portion 38 into the chamber 52, the intake stroke of the piston 32 will be stopped when the back surface 70 of the upper portion 34 thereof is abutted against the top rim 72 of the sealing member 50 which defines the open end of the chamber 52. As such, due to the construction of the seal assembly 48 as previously described, the clockwise rotation of the cap member 60 will cause the sealing member 50 to move axially inward and toward the first end 26*a* of the housing 26, thereby reducing the stroke of the piston 32. Conversely, the counter-clockwise rotation of the cap member 60 will cause the sealing member 50 to move axially outward and away from the first end 26*a* of the housing 26, thereby increasing the stroke of the piston 32. As will be recognized, by increasing or decreasing the stroke of the piston 32, the volume of the condiment receiving portion of the interior cavity 30 is likewise increased or decreased. Thus, the quantity of condiment that is drawn into and dispensed from the pump 12 may be selectively adjusted through the rotation of the cap member 60 of the seal assembly 48.

In addition to being slidably received into the chamber 52, the piston 32 is cooperatively engaged to the sealing member 50 via a tension spring 74 having one end rigidly attached to the inner surface of the cavity 40 adjacent the bottom wall 41 thereof, and an opposite end attached to the inner surface of the chamber 52 adjacent the bottom wall 53 thereof. When the opposed ends of the spring 74 are attached to the inner surfaces of the cavity 40 and chamber 52, the spring 74 extends axially between the bottom wall 41 of the cavity 40 and the bottom wall 53 of the chamber 52. Importantly, as seen in FIG. 4, the 35 spring 74 is sized so that when fully extended during an exhaust stroke of the piston 32, at least the bottom end of the lower portion 38 remains within the chamber 52. As such, the spring 74 prevents the piston 32 from sliding out of the sealing member 50 during an exhaust stroke thereof. In addition to maintaining the lower portion 38 of the piston 32 within the chamber 52, the spring 74 is also utilized to move the piston 32 through an intake stroke, as will be described below.

During the operation of the pump 12, the piston 32 is moved through an exhaust stroke by a pressurized fluid, preferably carbon dioxide, which enters the pump 12 via the inlet/exhaust port 12*c*. After entering the pump 12 through the inlet/exhaust port 12*c*, the pressurized fluid flows through the flow channel 56 and into the chamber 52 as well as the fluid receiving cavity 40 of the piston 32. As will be recognized, when an exhaust stroke of the piston 32 is initiated, the back surface 70 of the upper portion 34 will normally be abutted against the top edge 72 of the sealing member 50. When the chamber 52 and cavity 40 are filled with the pressurized fluid, the pressure of the fluid against the bottom wall 41 of the cavity 40 forces the piston 32 through an exhaust stroke. As the piston 32 moves through its exhaust stroke, the tension spring 74, which is originally in a compressed state, is stretched to the extended state shown in FIG. 4. As previously explained, the exhaust stroke of the piston 32 is stopped by the abutment of the wiper member 42 against the internal partition 46. After the piston 32 has competed its exhaust stroke, the pressurized fluid is vented from the fluid receiving cavity 40 and chamber 52 via the inlet/exhaust port 12*c*. As the pressurized fluid is being vented, the tension spring 74, which is in its extended state after the exhaust stroke, gradually returns to its compressed state, thus facilitating an intake stroke of the piston 32 by biasing it back toward the sealing member 50. The intake stroke of the piston 32 is stopped by the return of the back surface 70 of the upper portion 34 to its abutted engagement to the top rim 72 of the sealing member 50.

Referring now to FIGS. 4–7, a condiment product drawn into the interior cavity 30 via the product inlet 12*a* during an intake stroke of the piston 32 passes through an inlet check valve 76 positioned between the product inlet 12*a* and the piston 32. Similarly, when a condiment product is pushed by the piston 32 out of the interior cavity 30 and through the product outlet 12*b* during an exhaust stroke of the piston 32, the condiment passes through an outlet check valve 78 which is identically configured to the inlet check valve 76 and positioned between the product outlet 12*b* and piston 32. In the preferred embodiment, the inlet and outlet check valves 76, 78 each comprise a tubular sleeve portion 80 having an annular flange portion 82 extending about the inner surface thereof. The flange portion 82 itself defines a beveled inner surface 84 and a generally planar outer surface 86. Disposed within one end of the sleeve portion 80 is a compression spring 88 having a first end abutted against the outer surface 86 of the flange portion 82 and a second end having an anchor member 90 extending diametrically thereacross. Disposed within the opposite end of the sleeve portion 80 and positioned on the beveled inner surface 84 of the flange portion 82 is a spherical ball member 92.

The inlet and outlet check valves 76, 78 each further comprise an elongate tether member 94 having a proximal end rigidly attached to the ball member 92 and a distal end pivotally connected to an inwardly bowed central portion 96 of the anchor member 90. In the preferred embodiment, the tether member 94 extends axially through the spring 88 and the opening defined by the flange portion 82, and is sized to compress the spring 88 an amount sufficient to maintain the first end thereof in abutting contact with the outer surface 86 of the flange portion 82 while biasing the ball member 92 into sealed engagement against the beveled inner surface 84 of the flange portion 82, As seen in FIG. 4, the inlet check valve 76 is oriented such that the flow of condiment into the interior cavity 30 via the product inlet 12*a* during an intake stroke of the piston 32 will force the ball member 92 away from the beveled inner surface 84 (as shown in phantom) thus compressing the spring 88. Similarly, the outlet check valve 78 is oriented such that the flow of condiment out of the interior cavity 30 during an exhaust stroke of the piston 32 also forces the ball member 92 away from the beveled inner surface 84 (as shown in phantom in FIGS. 4 and 5) thus compressing the spring 88 (as shown in phantom in FIG. 5). During an intake stroke of the piston 32, the biasing force normally exerted on the ball member 92 by the spring 88 of the outlet check valve 78 maintains the ball member 92 in sealed engagement to the beveled inner surface 84 of the flange portion 82. Similarly, during an exhaust stroke of the piston 32, the biasing force normally exerted on the ball member 92 by the spring 88 of the inlet check valve 76 maintains the ball member 92 in sealed engagement to the beveled inner surface 84 of the flange portion 82.

Figure 5:
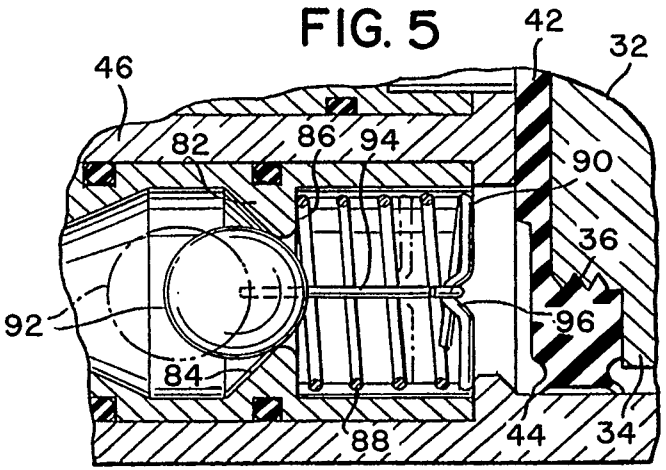
FIG. 5 is an enlarged cross-sectional view of the outlet check valve of the pump.
Figure 6:
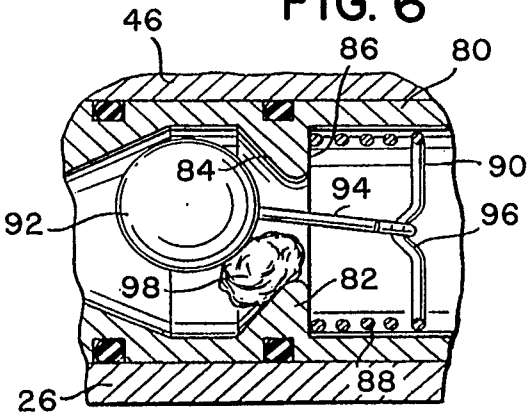
FIG. 6 is an enlarged cross-sectional view of the outlet check valve of the pump illustrating the manner in which the check valve is adapted to prevent clogging.
Figure 7:
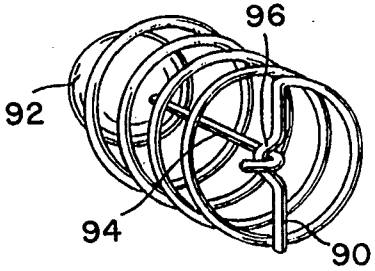
FIG. 7 is a perspective view of the spring, ball and tether members of the check valve.

As seen in FIG. 6, the pivotal connection of each ball member 92 to its respective anchor member 90 via the tether member 94 permits each ball member 92 to swivel and thus not be restricted to only axial movement as seen in FIGS. 4 and 5. As previously explained, the check valves of many prior art condiment dispensing pumps frequently become clogged, particularly when highly viscous, particle or chunk containing condiments such as relish or Thousand Island dressing are dispensed from the pump. Oftentimes these particles or chunks become lodged within the check valves thus preventing the proper closure thereof as is necessary during an intake or exhaust stroke of the pump piston. Due to the ability of the ball members 92 of the inlet and outlet check valves 76, 78 to swivel, large particles or chunks 98 contained in a condiment drawn into or pushed from the interior cavity 30 are able to angularly displace the ball member 92 toward the tubular sleeve portion 80, thus creating an opening of sufficient size to allow the particle 98 to easily pass into or out of the interior cavity 30. In those instances when the particle 98 is lodged between the ball member 92 and the beveled inner surface 84 at the termination of an intake or exhaust stroke of the piston 32, as shown in FIG. 6, the biasing force exerted on the ball member 92 by its associated compression spring 88 is generally sufficient to shear the particle 98 or force the particle 98 back toward the spring 88, thus allowing the ball member 92 to be properly sealed against the beveled inner surface 84 of the flange portion 82. As such, the configuration of the inlet and outlet check valves 76, 78 is specifically adapted to prevent the clogging thereof thus allowing the check valves 76, 78 to close as necessary during the intake and exhaust strokes of the piston 32.

Figure 10:
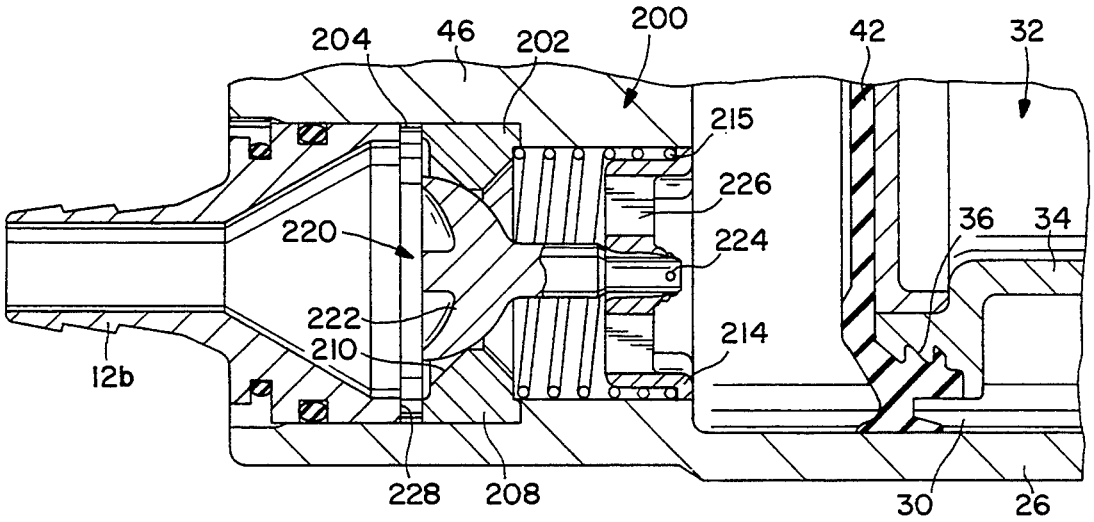
FIG. 10 is a cross-sectional view of a preferred outlet check valve when actuated to a closed position during an intake stroke of the piston.
Figure 11:
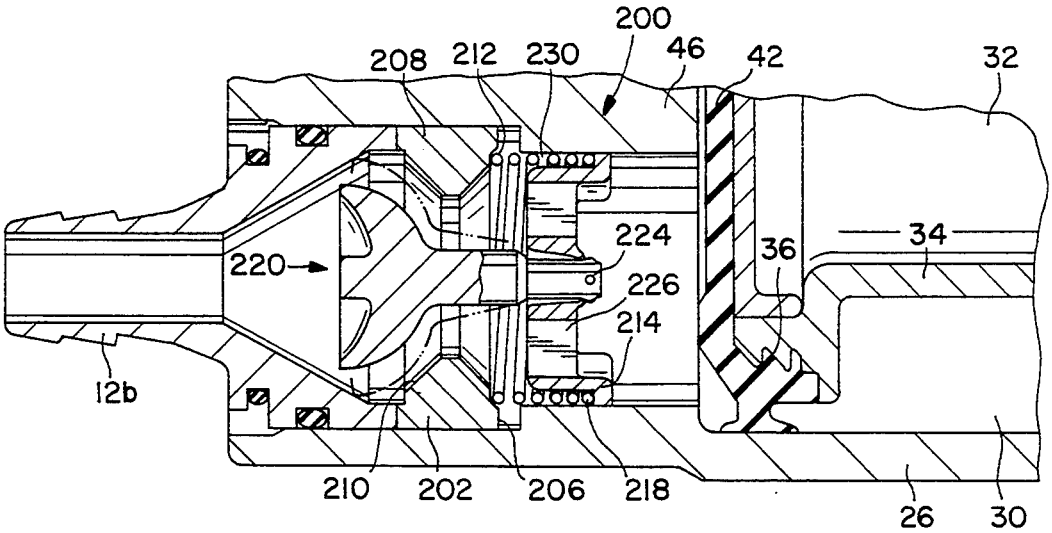
FIG. 11 is a cross-sectional view of the preferred outlet check valve when actuated to an open position during an exhaust stroke of the piston.

Referring now to FIGS. 10 and 11, illustrated in cross-section is an outlet check valve 200 which, in the preferred embodiment of the present invention, is utilized as an alternative to the outlet check valve 78 previously described. As will be discussed more fully below, the outlet check valve 200 is adapted to pull a vacuum within the product outlet 12(*b*) during the intake stroke of the piston 32 to eliminate the drippage of residual condiment from the condiment dispensing apparatus 10.

The outlet check valve 200 comprises a tubular sleeve 202 having a front end 204, a back end 206 and an annular flange 208 extending about the inner surface thereof. The annular flange 208 itself defines a beveled inner surface 210 and an annular outer shoulder 212. The outlet check valve 200 further comprises a base member 214 which is slidably positioned within the housing 26 intermediate the back end 206 of the tubular sleeve 202 and the interior cavity 30 of the pump housing 26. Extending between the tubular sleeve 202 and the base member 214 is a compression spring 216 having a first end abutted against the outer shoulder 212 of the flange portion 208 and a second end abutted against a shoulder 218 defined by the base member 214.

In addition to the aforementioned components, the outlet check valve 200 further comprises an umbrella member 220 having an arcuate proximal portion 222 which is normally biased into sealed engagement with the beveled inner surface 210 of the flange portion 208, and an elongate distal portion 224 which is pivotally connected to the base member 214. As seen in FIGS. 10 and 11, the umbrella member 220 extends axially through the compression spring 216 and is sized to compress the spring 216 an amount sufficient to bias the proximal portion 222 against the beveled inner surface 210 of the flange portion 208. Additionally, the outlet check valve 200 is oriented such that the flow of condiment out of the interior cavity 30 during an exhaust stroke of the piston 32 forces the proximal portion 222 away from the beveled inner surface 210, thus compressing the spring 216 in the manner shown in FIG. 11, and causing the base member 214 to be pulled toward the tubular sleeve 202. As seen in FIG. 10, during an intake stroke of the piston 32, the biasing force normally exerted on the base member 214 and thus the umbrella member 220 by the compression spring 216 maintains the proximal portion 222 in sealed engagement to the beveled inner surface of the flange portion 208. To facilitate the passage of condiment from the interior cavity 30 through the product outlet 12(*b*) during an exhaust stroke of the piston 32, the base member 214 includes a plurality of apertures 226 disposed therein, each of which define a separate condiment passage.

As previously explained, the outlet check valve 200 is adapted to pull a vacuum within the product outlet 12(*b*) to prevent the drippage of residual condiment from the dispensing apparatus 10. In this respect, the tubular sleeve 202 of the outlet check valve 200 is sized and slidably positioned in the housing 26 in a manner wherein the sleeve 202 is reciprocally movable within a space defined between the product outlet 12(*b*) and the interior cavity 30 during intake and exhaust strokes of the piston 32. Particularly, during an exhaust stroke of the piston 32 as shown in FIG. 11, the tubular sleeve 202 slides within the space to a first position in abutting contact with a first annular shoulder 228 defined by the product outlet 12(*b*). During an intake stroke of the piston 32 as shown in FIG. 10, the tubular sleeve 202 slides within the space to a second position in abutting contact with a second annular shoulder 230 defined within the housing 26 itself. Advantageously, the movement of the tubular sleeve 202 from the first position to the second position during the intake stroke of the piston 32 creates a vacuum within the product outlet 12(*b*) which is sufficient to prevent any residual condiment from dripping from the condiment dispensing apparatus 10.

As will be recognized, the movement of the tubular sleeve 202 from the first to the second positions during the intake stroke of the piston 32 occurs simultaneously with the rearward movement of the base member 214, caused by the return of the compression spring 216 to its extended position to place the proximal portion 222 into sealed engagement with the beveled inner surface 210. Similarly, the movement of the tubular sleeve 202 from the second to the first positions during an exhaust stroke of the piston 32 occurs simultaneously with the forward movement of the base member 214 caused by the compression of the spring 216 due to the forcing of the proximal portion 222 away from the beveled inner surface 210 by the outbound flow of condiment. As seen in FIG. 11, the pivotal connection of the distal portion 224 of the umbrella member 220 to the base member 214 allows the proximal portion 222 to swivel relative the beveled inner surface 210 to prevent large particles or chunks contained in a condiment from clogging the outlet check valve 200, in the same manner as previously described with respect to the outlet check valve 78.

Though not shown, as an alternative to the inlet check valve 76 previously described, the pump 12 may be provided with an inlet check valve similar in construction to the outlet check valve 200. In this respect, such an inlet check valve would be identically configured to the outlet check valve 200, except that the tubular sleeve thereof would be sized so as to be rigidly maintained between the first and second annular shoulders 228, 230 and thus not reciprocally movable due to the lack of a need to pull a vacuum within the product inlet 12(*a*). Like the inlet check valve 76, the alternative inlet check valve would be positioned between the product inlet 12(*a*) and the piston 32, and would be oriented such that the flow of condiment into the interior cavity 30 via the product inlet 12(*a*) during an intake stroke of the piston 32 would force the proximal portion 222 of the umbrella member 220 away from the beveled inner surface 210, thus compressing the spring 216. During an exhaust stroke of the piston 32, the biasing force normally exerted on the umbrella member 220 by the compression spring 216 would maintain the proximal portion 222 of the umbrella member 220 of the inlet check valve in sealed engagement to the beveled inner surface 210 of the flange portion 208.

DISPENSING APPARATUS CONFIGURATION

Referring now to FIGS. 1–3, the dispensing apparatus 10 generally comprises a handle portion 100 having an outlet nozzle 102 fluidly coupled to one end thereof. Disposed within the end surface 104 of the handle portion 100 which is opposite the end adjacent the outlet nozzle 102 are a plurality of apertures which are interfaced to the pumps 12, 14, 16 and carbon dioxide source 18 as will be described below. The control of the condiment flow through the dispensing apparatus 10 is regulated by a valve assembly disposed within the handle portion 100.

Referring now to FIGS. 8 and 9, the valve assembly generally comprises a first valve stem assembly 106, a second valve stem assembly 108, and a third valve stem assembly 110. Each of the valve stem assemblies 106, 108, 110 have identical configurations, and therefore the particular structures associated with each such valve stem assembly will be described with respect to the first valve stem assembly 106, though it will be recognized that this particular assembly has been selected arbitrarily. The first valve stem assembly 106 generally comprises an elongate valve stem 112 (shown in perspective in FIG. 9) having a top end 114 and a bottom end 116. Attached to the top end 114 of the valve stem 112 is a manual actuation button 118. Formed in the valve stem 112 adjacent the top end 114 is a first annular recess or slot 120, while formed adjacent the bottom end 116 is a second annular slot 122. The valve stem 112 further includes a first radially extending flange 124 and a second radially extending flange 126 which are oriented between the first and second slots 120, 122 and define a third annular slot 128. Disposed within the outer, peripheral surface of the first flange 124 is at least one and preferably four V-shaped notches 125 which are equidistantly positioned about the first flange 124, i.e. in approximately 90 degree intervals, and are oriented such that the lower, narrow ends thereof terminate into the third slot 128. The use of the V-shaped notches 125 will be discussed below. Disposed within the first slot 120 is a first O-ring 130, while disposed in the second slot 122 is a second O-ring 132. Additionally, disposed in the third slot 128 between the first and second flanges 124, 126 is a third O-ring 134.

Extending longitudinally through the handle portion 100 in substantially parallel relation are a first fluid passage 136 and a second fluid passage 138. As seen in FIG. 8, each valve stem assembly 106, 108, 110 is disposed within an inner chamber formed within the handle portion 100 having open top and bottom ends. Each inner chamber defines a cylindrical upper region 140 and a cylindrical lower region 142 which is of greater diameter than the upper region 140 and separated therefrom by an annular shoulder 144. Inserted into the open bottom end of the lower region 142 and enclosing the same is a stop member 146 defining a cylindrically configured recess 148 in its upper end and an annular lip 150 extending about its lower end. Extending axially through the lower end of the stop member 146 is an exhaust passage 152 and a threaded aperture, each of which extend between the exterior of the handle portion 100 and the recess 148. Threadably received into the aperture is an adjustment member 154 such as a screw. When the adjustment member 154 is received into the threaded aperture, the exhaust passage 152 forms the sole passage fluidly connecting the recess 148 to the ambient air exterior of the handle portion 100. The first valve stem assembly 106 further comprises a biasing spring 156 which extends axially through the lower region 142 of the inner chamber between the lip 150 of the stop member 146 and the bottom surface of the second flange 126.

As seen in FIG. 8, the valve stem assemblies 106, 108, 110 are each shown in various stages of actuation wherein the first valve stem assembly 106 is in an unactuated position, the second valve stem assembly 108 is in an intermediate stage of actuation, and the third valve stem assembly 110 is shown as being fully actuated. When a valve stem assembly 106, 108, 110 is in the unactuated position, the valve stem 112 and hence the actuation button 118 are maintained in a raised orientation due to the upward biasing force exerted by the biasing spring 156 on the valve stem 112, and more particularly the second flange 126 thereof. Attached to the top surface of the handle portion 100 is a switch plate 158 including three apertures disposed therein adapted to accommodate the manual actuation buttons 118 of the valve stem assemblies 106, 108, 110. When in the raised orientation, each actuation button 118 is maintained within the switch plate 158 via the abutment of a lower, radially extending flange 160 thereof against a corresponding annular shoulder 162 formed in the switch plate 158.

When a pressurized fluid is introduced into the dispensing apparatus 10, the fluid travels through the first passage 136 in the direction A. The pressurized fluid then enters the upper region 140 of each inner chamber and is contained in the space defined between the inner surface of the upper region 140 and the portion of the valve stem 112 disposed between the first and third O-rings 130, 134. When the pressurized fluid initially enters the upper regions 140 of the inner chambers, the valve stems 112 will be biased to the raised orientation as shown with respect to the first valve Stem assembly 106. Importantly, the pressurized fluid is prevented from escaping through the open top end of each upper region 140 by the first O-ring 130 which creates a sliding seal between the valve stem 112 and the inner surface of the upper region 140. Though when contained in the upper region 140, the pressurized fluid flows through each of the four V-shaped notches 125 disposed in the outer surface of the first flange 124, the pressurized fluid is also prevented from flowing into the lower region 142 by the abutment of the third O-ring 134 against the annular shoulder 144 defined between the upper and lower regions 140, 142. In this respect, the third O-ring 134, when abutted against the annular shoulder 144, blocks the lower, narrow ends of each of the four V-shaped notches 125. As such, when the valve stem 112 of a valve stem assembly 106, 109, 110 is in the raised orientation, the pressurized fluid is confined in the upper region 140 between the first and third O-rings 130, 134 as previously specified.

As also seen in FIG. 8, each valve stem 112 and its associated stop member 146 are oriented relative each other such that the bottom end 116 of the valve stem 112 is always disposed within the recess 148 of the stop member 146, even when the valve stem 112 is biased to its raised orientation by the biasing spring 156. Though the pressurized fluid is confined in the upper region 140 between the first and third O-rings 130, 134 when each valve stem assembly 106, 108, 110 is in the unactuated position, an open fluid passageway is created between the second fluid passage 138 and ambient air. In this respect, pressurized fluid introduced into the dispensing apparatus 10 in the direction B when the valve stem assemblies 106, 108, 110 are in the unactuated position enters the lower region 142 of each inner chamber and is prevented from flowing upwardly into the upper region 140 by the abutment of the third O-ring 134 against the annular shoulder 144. As a result, the fluid flows downwardly through the lower region 142 past the second O-ring 132 and between the bottom end 116 of the valve stem 112 and the upper rim 149 of the cylindrical recess 148. After entering the recess 148, the fluid flows from the interior thereof through the exhaust passage 152 to the ambient air exterior of the handle portion 100.

Each valve stem assembly 106, 108, 110 is moved to the actuated position by applying a downward force to a respective actuation button 118.. The application of this downward force overcomes the upward biasing force exerted by the biasing spring 156 thus causing the valve Stem 112 to move downwardly, as shown in relation to the second valve stem assembly 108 which is in a partially actuated position. As the valve stem 112 moves downwardly, the third O-ring 134 moves out of abutting contact with the annular shoulder 144, while the second O-ring 132 moves downwardly past the upper rim 149 of and into the recess 148 of the stop member 146. When a valve stem assembly 106, 108, 110 is in the fully actuated position, as shown in relation to the third valve stem assembly 110, the third O-ring 134 is separated from the annular shoulder 144 with the second O-ring 132 being in abutting sealed engagement with the cylindrical inner surface of the .recess 148. As such, pressurized fluid is able to flow from the first fluid passage 136, into the upper region 140 and through the V-shaped notches 125 into the lower region 142. The pressurized fluid within the lower region 142 is prevented from flowing through the exhaust passage 152 by the seal created by the second O-ring 132, and thus flows through the second fluid passage 138 in the direction C. As will be recognized, when each valve stem assembly 106, 108, 110 is moved from the unactuated position to the actuated position, the V-shaped notches 125 create a third flow passage between the upper and lower regions 140, 142 of the inner chambers.

Since the V-shaped notches 125 form a flow passage between the upper and lower regions 140, 142 when each valve stem assembly 106, 108, 110 is moved to the actuated position, the flow rate of the pressurized fluid through the second fluid passage 138 in the direction C will be dictated by the flow rate of pressurized fluid through the V-shaped notches 125. In the preferred embodiment of the present invention, the flow of the pressurized fluid through the V-shaped notches 125 of the valve stem 112 is regulated by the adjustment member 154. In this regard, the downward stroke of the valve stem 112 as each valve stem assembly 106, 108, 110 is being moved to the actuated position may be selectively adjusted through the positioning of the distal end 164 of the adjustment member 154 within the recess 148. Since the adjustment member 154 is threadably received into the stop member 146, the clockwise rotation thereof will cause the axial position of the distal end 164 to move upwardly within the recess 148. Conversely, the counter-clockwise rotation of the adjustment member 154 will cause the axial position of the distal end 164 to be lowered within the recess 148. As such, the distal end 164 may be used to limit the downward stroke of the valve stem 112 since the downward stroke will be stopped when the bottom end 116 of the valve stem 112 comes into abutting contact with the distal end 164. Thus, rotation of the adjustment member 154 in the clockwise direction decreases the downward stroke of the valve stem 112, while rotation of the adjustment member 154 in the counter-clockwise direction increases the downward stroke of the valve stem 112. As seen in relation to the third valve stem assembly 110, the adjustment member 154 may be positioned such that the distal end 164 thereof does not extend beyond the bottom surface 166 of the recess 148. When the distal end 164 is disposed below the bottom surface 166, the downward stroke of the valve stem 112 will be stopped by the direct abutment of the bottom end 116 thereof against the bottom surface 166.

As further seen in FIG. 8, due to the location of the first flange 124 on the valve stem 112 and the orientation of the V-shaped notches 125 therein, the downward stroke or travel of the valve stem 112 when each valve stem assembly 106, 108, 110 is moved from the unactuated position to the actuated position must be sufficient so as to cause at least a portion of the V-shaped notches 125 to extend below the annular shoulder 144. In this respect, to achieve the necessary flow rate of the pressurized fluid from the first fluid passage 136 into the second fluid passage 138, the pressurized fluid must flow directly from each V-shaped notch 125 into the lower region 142. Due to the configuration of the V-shaped notches 125, the greater the length thereof disposed below the annular shoulder 144, the greater the flow rate of the pressurized fluid entering the lower region 142 and hence the second fluid passage 138. Thus, the flow rate of fluid through the third passage defined by the V-shaped notches 125 may be regulated by controlling the distance the V-shaped notches 125 extend downwardly beyond the annular shoulder 144. Advantageously, this distance is controlled via the selective limitation of the downward stroke or travel of the valve stem 112 as each valve stem assembly 106, 108, 110 is moved from the unactuated to the actuated positions. Since the rotation of the adjustment member 154 in the clockwise direction decreases the downward travel of the valve stem 112, such rotation will shorten the length of the V-shaped notches 125 extending downwardly beyond the annular shoulder 144. Conversely, since the rotation of the adjustment member 154 in the counter-clockwise direction increases the downward travel of the valve stem 112, such rotation will increase the length or amount of the V-shaped notches 125 extending downwardly beyond the annular shoulder 144. Thus, by selectively rotating the adjustment member 154, the flow rate of the pressurized fluid traveling through the second fluid passage 138 in the direction C can be regulated. The .desirability of such flow regulation will be described below.

In the preferred embodiment, the head portions of each of the adjustment members 154 reside within a recess 168 formed in the bottom surface of the handle portion 100 so as to prevent the adjustment members 154 from extending outwardly beyond the bottom surface and interfering with the hand of the user of the dispensing apparatus 10. Additionally, the recess 168 may be covered by a cover member 170 so as to prevent any inadvertent rotation of the adjustment members 154.

DISPENSING SYSTEM OPERATION

Having thus described the structure of the pumps 12, 14, 16, and dispensing apparatus 10, the flow patterns in operation of the dispensing system will now be described.

Referring now to FIGS. 1–4 and 8, pressurized fluid from the carbon dioxide gas source 18 is channeled into the dispensing apparatus 10 through an aperture 18 disposed in the end surface 104. To facilitate the exhaust stroke of the piston 32, the valve stem 112 is moved to the second, fully actuated position as shown in relation to the valve stem assembly 110. Pressurized fluid from the carbon dioxide source 18 entering the handle portion 100 via the aperture 18' will enter and flow through the first fluid passage 136 in the direction A and into the upper region 140 of each inner chamber. To facilitate an exhaust stroke of the piston 32, a selected valve stem assembly 106, 108', 110 will be moved to the actuated position, thus allowing the pressurized fluid to travel downwardly from the upper region 140, through the V-shaped notches 125 and into the lower region 142. Thereafter, the fluid will flow from the lower region 142 through the second fluid passage 138 in the direction C. From the second fluid passage 138, the pressurized fluid will exit through an aperture **12*c'* disposed in the end surface 104 and be channeled into the inlet/exhaust port 12*c*, thereby initiating an exhaust stroke, i.e. a pumping stroke of the piston 32, which pushes the condiment out of the interior cavity 30 via the outlet check valve 78 and product outlet 12*b***, as previously described.

From the product outlet **12*b*, the condiment is forced into the dispensing apparatus 10 via an aperture 12*b'* disposed in the end surface 104, and will exit the dispensing apparatus 10 via an aperture 12*b''* disposed within the bottom of the outlet nozzle 102. After the exhaust stroke of the piston 32 has been completed, i.e. the wiper member 42 is abutted against the internal partition 46, the downward force originally applied to the actuation button 118** to initiate the exhaust stroke is removed, thus returning the valve stem assembly to its original, unactuated position.

When the valve stem assembly is returned to its unactuated position, the flow of pressurized fluid into the lower region 142 is stopped by the abutment of the third O-ring 134 against the annular shoulder 144, with an open passage between the second fluid passage 138 and ambient air being defined by the lower region 142, recess 148 and exhaust passage 152. The pressurized fluid used to initiate the exhaust stroke of the piston 32 will exit the pump 12 via the inlet/exhaust port **12*c* and will re-enter the handle portion 100 via the aperture 12*c'*. Thereafter, the pressurized fluid will flow through the second fluid passage 138 in the direction B and will be exhausted to ambient air via the previously described flow path when the valve stem assembly is returned to the unactuated position. As the pressurized fluid is vented from the pump 12, tee extended tension spring 74 initiates the intake stroke of the piston 32, thus allowing condiment to be drawn into the interior cavity 30 from the bag-in-box reservoir 20 via the product inlet 12***a* and inlet check valve 76. As will be recognized, a procedure identical to the aforementioned procedure occurs with respect to the inlet/outlet ports 14*a*, 14*b*, 14*c* of pump 14, and apertures 14*l'*, 14*c'*, and 14*b''* of dispensing apparatus 10, as well as inlet/outlet ports 16*a*, 16*b*, 16*c* of pump 16 and apertures 16*b'*, 16*c'* and 16*b''* of dispensing apparatus 10. Thus, in the preferred embodiment of the present invention, three varieties of condiments may be dispensed from the dispensing apparatus 10, though it will be appreciated that more or less pumps and valve stem assemblies may be utilized to dispense different numbers of condiments.

Since the viscosities associated with the condiments dispensed from the present dispensing system may necessitate varying the amount of force exerted by the piston 32 during an exhaust stroke, the flow rate of the pressurized fluid entering into the inlet/exhaust port 12*c* to facilitate an exhaust stroke of the piston 32 may be varied in the previously described manner. For example, the flow rate of fluid entering the pump 12 to initiate an exhaust stroke of the piston 32 would be greater for highly viscous condiments such as relish or Thousand Island dressing, than for less viscous condiments such as ketchup and mustard which would normally splatter if a flow rate identical to that used for the more viscous condiments was used. Advantageously, the flow rates of fluid through each of the valve stem assemblies 106, 108, 110 may be individually adjusted depending upon the particular type of condiment disposed within the reservoir with which each valve stem assembly is associated.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A fluid driven pump for use in a condiment dispensing system, comprising:

a housing defining at least one interior cavity;

a piston positioned within said housing and reciprocally movable through intake and exhaust strokes within said interior cavity for selectively drawing a predetermined quantity of condiment thereinto and dispensing the predetermined quantity therefrom;

a product inlet disposed within the housing for placing said interior cavity in fluid communication with a condiment reservoir during the intake stroke of the piston;

a product outlet disposed within said housing for placing said interior cavity in fluid communication with a condiment dispensing apparatus during the exhaust stroke of the piston;

an inlet check valve positioned within the housing between said product inlet and said interior cavity; and an outlet check valve positioned within said housing between said product outlet and said interior cavity, said outlet check value comprising:

an annular sleeve defining a flow path between the product outlet and the interior cavity and reciprocally movable between first and second positions, said sleeve being pushed to the first position during the exhaust stroke of the piston and pulled to the second position during the intake stroke of the piston; and an umbrella member cooperatively engaged to the sleeve and reciprocally movable between a closed position wherein the flow path is blocked thereby and an open position wherein the flow path is unblocked, said umbrella member being pushed to the open position during the exhaust stroke of the piston and pulled to the closed position during the intake stroke of the piston;

the movement of the sleeve from the first position to the second position during the intake stroke of the piston being adapted to pull a vacuum within said product outlet to eliminate drippage of residual condiment from said condiment dispensing apparatus.

2. The fluid driven pump of claim 1 wherein the movement of the umbrella member to the open position occurs simultaneously with the movement of the sleeve to the first position, and the movement of the umbrella movement to the closed position occurs simultaneously with the movement of the sleeve to the second position.

* * * * *